US005088138A

United States Patent [19]

Munster

[11] Patent Number: 5,088,138

[45] Date of Patent: Feb. 18, 1992

[54] CRY RESPONSIVE BABY CRIB

[76] Inventor: Candice W. Munster, P.O. Box 155, Westin, Tex. 75097

[21] Appl. No.: 664,939

[22] Filed: Mar. 5, 1991

[51] Int. Cl.[5] ..... A47D 9/02

[52] U.S. Cl. ..... 5/109; 5/101

[58] Field of Search ..... 5/108, 109, 101-107; 128/33

[56] References Cited

U.S. PATENT DOCUMENTS

| | | | |
|---|---|---|---|
| 2,380,355 | 7/1945 | Worley | 5/109 |
| 3,031,687 | 5/1962 | Stevens et al. | 5/109 |
| 3,125,767 | 3/1964 | Griggs et al. | 5/109 |
| 3,439,363 | 4/1969 | Meeks | 5/109 |
| 3,842,450 | 10/1974 | Pad | 5/109 |
| 3,952,343 | 4/1976 | Wong | 5/109 |
| 4,419,777 | 12/1983 | Parker | 5/108 |
| 4,615,059 | 10/1986 | Darowski | 5/108 |
| 4,639,959 | 2/1987 | Roca | 5/451 |
| 4,681,096 | 7/1987 | Cuervo | 128/33 |

*Primary Examiner*—Alexander Grosz

[57] ABSTRACT

A baby crib having an automatic swinging apparatus includes a bed frame assembly supported on a base platform by flexible straps. The crib has an electric motor for swinging the rocker. Swinging reversal forces are reacted smoothly by tension springs which alternately store and release energy during each swing cycle so that the momentum of the swinging crib is overcome at each reversal of swinging movement.

10 Claims, 2 Drawing Sheets

CRY RESPONSIVE BABY CRIB

FIELD OF THE INVENTION

This invention relates generally to baby beds and cribs, and in particular, to a baby crib having an automatic rocking apparatus.

BACKGROUND OF THE INVENTION

It has always been a challenge to parents to sooth and pacify restless or crying infants. Each time an infant cries or becomes restless, parents must drop everything they are doing to provide immediate attention. Generally, the preferred practice to comfort a crying infant is by rocking the infant in a cradle or in its mother's arms.

DESCRIPTION OF THE PRIOR ART

In U.S. Pat. No. 4,681,096, a voice actuated rocking apparatus for a baby crib provides rhythmic motions which have a soothing effect on an infant. Also, a swing set having an electrical solenoid for periodically applying a swinging force is disclosed in U.S. Pat. No. 3,842,450. A rocking apparatus that generates repetitive waves for a water bed is disclosed in U.S. Pat. No. 4,639,959.

U.S. Pat. No. 3,952,343 discloses a spring system that provides an oscillating motion to a baby crib. U.S. Pat. No. 4,419,777 discloses a rocking apparatus that utilizes a transverse member for supporting the front leg of a crib and a similar transverse member supporting the rear leg of a crib. The transverse support members are pivoted at their center, with one of the rocking members being oscillated by a cam mounted on the traverse support member. The use of brackets, U-shaped pivots, interconnected levers and rotating disks require high power electric motors for starting and sustaining the crib rocking motion. Consequently, the cooperating parts must be maintained in precise alignment to impart a smooth rocking motion.

OBJECTS OF THE INVENTION

The principal object of the present invention is to provide a baby crib having an improved rocking apparatus.

A related object of the present invention is to provide an improved automatic rocking apparatus for a baby crib which is driven by a fractional horsepower induction motor.

Yet another object of the present invention is to provide an automatic rocker for a baby crib that is easy to set up and maintain.

SUMMARY OF THE INVENTION

A baby crib having an improved rocking apparatus of the present invention includes a headboard, a footboard, side bars, cross members and front and rear side panels, all of which are interconnected such that the cross members traverse the front and rear side members providing support for a mattress or box spring. The crib has a foundation including a base, posts, cross arms and support beams. The crib is suspended from the cross arms above the floor by flexible straps, which permit the crib to swing freely to and fro.

Gentle swinging motion is provided by a small fractional horsepower induction electric motor. The rotor of the induction motor is coupled to the crib by a crank arm and a pair of tension springs. The amplitude of swinging motion imparted to the crib is determined by the offset coupling position of the crank arm. The swinging period is proportional to the RPM of the motor. Swinging reversal forces are reacted smoothly by the tension springs. The tension springs alternately store and release energy during each swing cycle so that the momentum of the swinging crib is overcome at each reversal of swinging movement.

BRIEF DESCRIPTION OF THE DRAWINGS

The foregoing objects, features, and advantages of the invention will be understood when the following detailed description is read with reference to the accompanying drawings, in which.

DETAILED DESCRIPTION OF THE PREFERRED EMBODIMENT

Figure 1:
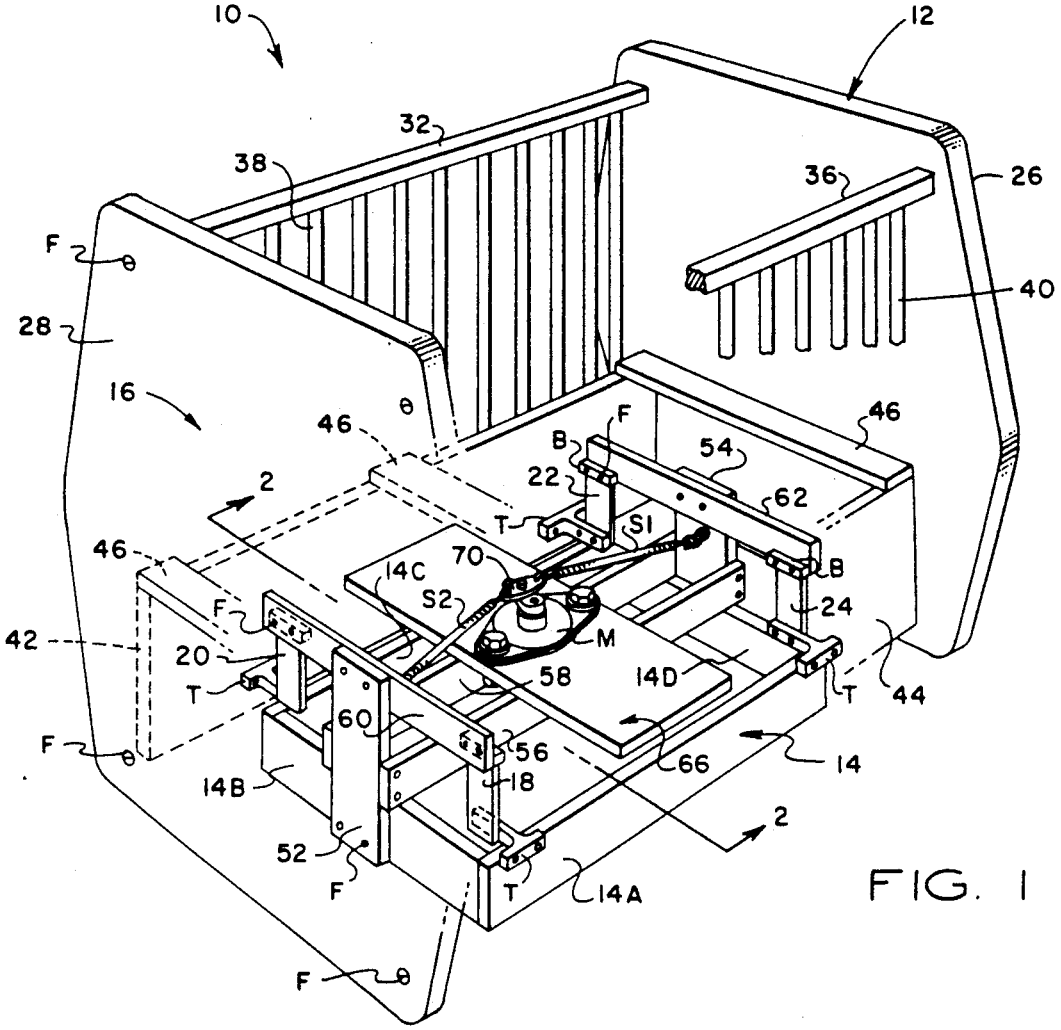
FIG. 1 is a perspective view of a crib constructed according to the present invention.

In the description which follows, like parts are indicated throughout the specification and drawings with the same reference numerals, respectively. The drawings are not necessarily to scale, and certain parts have been exaggerated to better illustrate details of the present invention.

Figure 2:
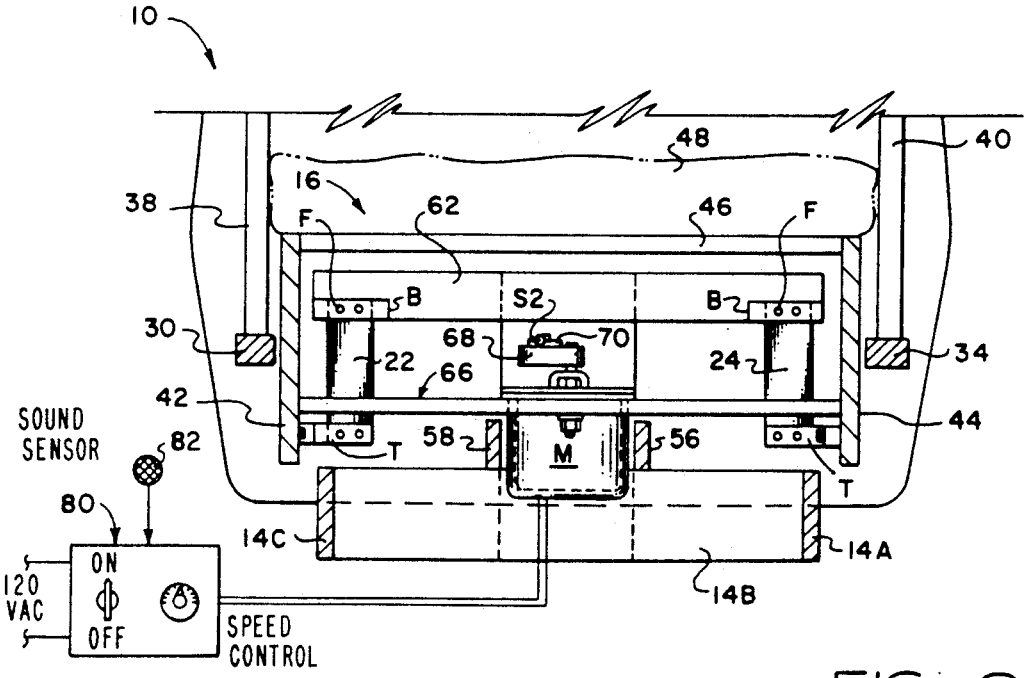
FIG. 2 is a partial sectional view thereof taken along the line 2—2 of FIG. 1.
Figure 3:
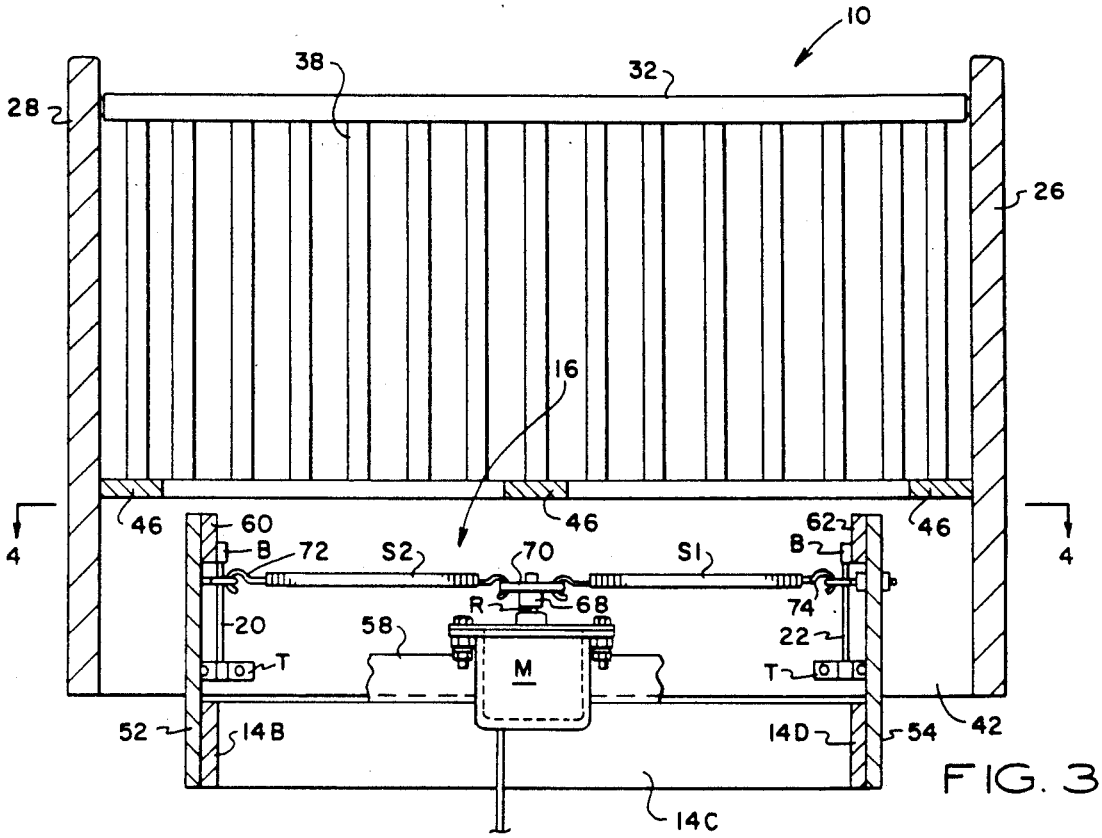
FIG. 3 is a side sectional view taken along the line 3—3 of FIG. 4; and, FIG. 4 is a top view of the baby crib shown in FIG. 1, partly in section and taken along the line 4—4 of FIG. 3.
Figure 4:
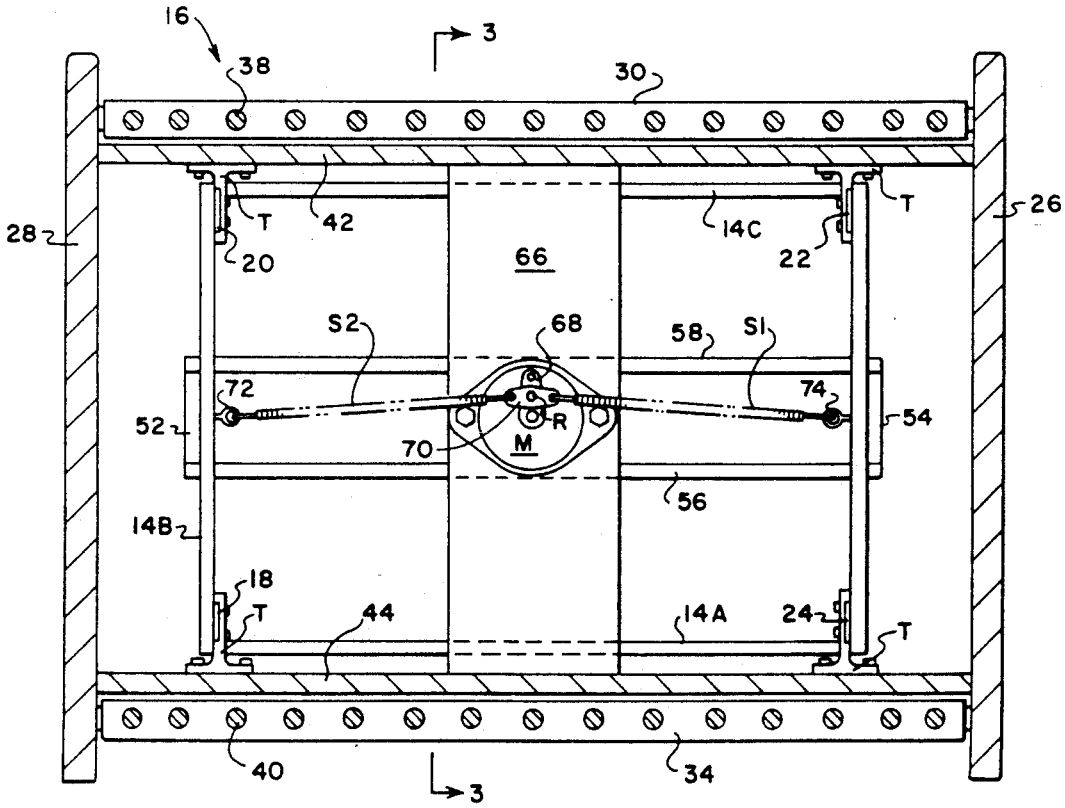

Referring to FIG. 1 and FIG. 2, the crib 10 of the present invention includes a movable bed frame assembly 12 which is coupled to a stationary base platform 14 by an automatic rocker assembly 16. In the preferred embodiment of the invention, the rocker assembly 16 is mounted on the bed frame assembly 12, and the bed frame assembly 12 is suspended from the base platform 14 by flexible straps 18, 20, 22 and 24.

The bed frame assembly includes a headboard 26 and a footboard 28, which are joined together by side rails 30, 32, 34 and 36. The side rails 30, 32 are joined together by an array of vertical safety bars 38, and the side rails 34, 36 are joined together by a vertical array of safety bars 40. The headboard and footboard are further interconnected by a rear bed frame 42 and a front bed frame 44. A plurality of slats 46 are mounted transversely across the top of the front and rear bed frames, and provide support for a crib mattress or box spring 48. The side rails and bed frames are attached to the headboard and footboard by screw fasteners F. Other fastening means, for example brackets, may be used if desired.

The base platform 14 is constructed in a rectangular configuration with upright foundation boards 14A, 14B, 14C and 14D. Vertical support for the bed frame assembly 12 is provided by a pair of stanchions 52, 54 which are attached to the foundation boards 14B, 14D by screw fasteners F. The base platform 14 and stanchions 52, 54 are stabilized by cross beams 56, 58.

Cross arms 60, 62 are attached by screw fasteners F to the upper portions of the stanchions 52, 54, and extend substantially at a right angle with respect to each stanchion. The support straps 18, 20 are fastened onto and depend downwardly from the first cross arm 60, and the flexible support straps 22, 24 are likewise attached to and depend downwardly from the second cross arm 62.

The cross arms, stanchions, foundation base 14 and cross beams 56, 58 are preferably made of wooden boards.

The straps are connected onto the cross arms 60, 62 by mounting blocks B and screw fasteners F. The lower ends of the flexible straps are fastened onto the rear bed frame 42 and the front bed frame 44 by T-brackets T and screw fasteners. The straps 18, 20, 22 and 24 can be made of any flexible material having strong tensile strength, for example nylon webbing.

According to an important aspect of the present invention, the rocker 12 also has a motion support platform 66 transversely located between and attached to a central portion of the rear and front frames 42, 44. An induction motor M is attached and mounted to a central portion of the motion support platform 66. The induction motor M assembly includes a crank arm 68, an idler arm 70 and tension springs S1, S2. The tension springs S1, S2 are connected at one end to the stanchions 52, 54 with eye bolts 72, 74 and the opposite ends of the tension springs are connected to the idler arm 70.

In operation, the rotor shaft R of the induction motor M and the crank arm 68 rotate in either a clockwise or counterclockwise direction. As the rotor shaft R rotates, the crank arm 68 starts to load energy into one of the tension springs causing the tension spring to stretch and store energy, thus producing a pulling force between the bed frame assembly 12 and the base platform 14. Consequently, this stored energy causes the bed frame assembly 12 to swing to one side, and when the motor M rotates past its apogee, energy is no longer applied to the tension springs. However, as the motor shaft rotates, it loads the other spring with energy thus causing the restoration of energy to the system, and the cycle continues. Furthermore, the magnitude of motion can be adjusted by changing the offset of the idler arm 70 which is attached to the crank arm 68.

Preferably, the operating speed of the motor M is adjustable to operate in a slow RPM range, for example from 1–3 revolutions per minute. Speed control is provided by a controller 80, which includes a microphone 82 for detecting crying sounds. The controller is also adjustable for applying operating power to the motor M in response to such sounds.

While a preferred embodiment of the present invention has been shown and described herein, further modifications and improvements may be made by those skilled in the art. For example, the bed frame assembly could be rotated 90 degrees above the base platform, or the brackets could be attached to the headboard or the footboard. The foregoing description of the invention is presented in explanation thereof, and various changes in size, shape and materials, as well as in the details of the illustrated construction may be made without departing from the spirit of the invention.

What is claimed is:

1. A baby crib comprising, in combination:

a bed frame assembly;

a foundation base;

first and second stanchions attached to said foundation base and projecting upright therefrom;

first and second cross arms attached to said first and second stanchions, respectively, and projecting transversely with respect thereto;

a plurality of flexible straps attached to said cross arms and said bed frame assembly, said flexible straps suspending said bed frame from said first and second cross arms, respectively;

a motor mounted on said bed frame assembly for imparting swinging motion to said bed frame, said motor having a rotor shaft; and, apparatus coupling said bed frame assembly to said rotor shaft.

2. A baby crib as defined in claim 1, wherein said crib further comprises:

a headboard, a footboard, sideboards and front and rear side frames, all of which are interconnected to form said bed frame assembly; and, slats traversing said front and rear side frames providing support for a crib mattress or box spring.

3. A baby crib as defined in claim 1, wherein said crib includes a motion support platform, said motion support platform being attached to said bed frame assembly, and said motor being mounted on said motion support platform for swinging said bed frame assembly above said foundation base.

4. A baby crib as defined in claim 1, including a crank arm attached to said rotor shaft and first and second tension springs coupled to said foundation base and to said crank arm.

5. A baby crib comprising, in combination:

a rocker, said rocker having a headboard, a footboard, side rails, and front and rear side frames, all of which are interconnected to form said rocker; a plurality of slats traversing said front and rear side frames for providing support for a crib mattress or box spring;

a foundation, said foundation having a base, first and second stanchions, and first and second cross arms, said first and second stanchions projecting upright from opposite ends of said base, said first and second cross arms being attached to respective upper portions of said first and second stanchions;

a plurality of brackets attached to the front and rear side frames;

a plurality of straps attached to opposite end portions of said cross arms, and said straps being attached to said brackets, said brackets being fastened to said front and rear side frames such that said rocker is suspended from said cross arms by said straps above said foundation;

a motion support platform, said motion support platform being attached to said front and rear side frames;

an electric motor mounted on said motion support platform, said electric motor having a rotor shaft;

a crank arm attached to said rotor shaft; and, first and second tension springs coupled to said foundation and said crank arm.

6. A baby crib as defined in claim 5, wherein said tension springs are attached to said first and second stanchions and said crank arm.

7. A crib having an automatic rocker assembly comprising, in combination:

a rocker, said rocker having a headboard, a footboard, side rails, and front and rear side frames, all of which are interconnected to form said rocker; and, a plurality of slats traversing said front and rear side frames providing support for a crib mattress or box spring;

a foundation, said foundation having a base, first and second stanchions, and first and second cross arms, said first and second stanchions projecting upright from opposite ends of said base, and said first and second cross arms being attached to respective upper portions of said first and second stanchions;

a plurality of brackets attached to the front and rear side frames;

a plurality of straps attached to opposite end portions of said cross arms, and said straps being attached to said brackets;

said brackets being fastened to said front and rear side frames such that said rocker is suspended from said cross arms by said straps above said foundation;

a motion support platform, said motion support platform transversely located between and attached to said front and rear side frames; and, a motor mounted on said motion support platform for swinging said rocker, said motor having a crank arm and first and second tension springs, where said first and second tension springs are connected to said foundation and said crank arm.

8. A baby crib as defined in claim 7, wherein said tension springs are attached to said first and second stanchions and to said crank arm.

9. A baby crib as defined in claim 8, including an idle arm adjustably attached to said crank arm, whereby the amplitude of swinging motion of said rocker can be adjusted.

10. A baby crib comprising, in combination:

a support platform adapted for horizontal placement onto a floor;

first and second stanchions attached to said platform and projecting upright therefrom;

first and second cross arms attached to said first and second stanchions, respectively, and projecting transversely with respect thereto;

a bed frame assembly;

a plurality of flexible straps attached to said cross arms and said bed frame assembly, said flexible straps suspending said bed frame from said first and second cross arms, respectively;

an electric motor mounted on said bed frame, said electric motor having a power shaft; and, means coupling said power shaft to said support platform.

* * * * *